US005157943A

United States Patent [19]

Jaster et al.

[11] Patent Number: 5,157,943

[45] Date of Patent: Oct. 27, 1992

[54] REFRIGERATION SYSTEM INCLUDING CAPILLARY TUBE/SUCTION LINE HEAT TRANSFER

[75] Inventors: Heinz Jaster, Schenectady, N.Y.; LeRoy J. Herbst, Louisville, Ky.

[73] Assignee: General Electric Company, Schenectady, N.Y.

[21] Appl. No.: 821,317

[22] Filed: Jan. 13, 1992

Related U.S. Application Data

[63] Continuation of Ser. No. 612,051, Nov. 9, 1990, abandoned.

[51] Int. Cl.[5] ..... F25B 41/04

[52] U.S. Cl. ..... 62/513; 62/526

[58] Field of Search ..... 62/113, 513, 526

[56] References Cited

U.S. PATENT DOCUMENTS

| | | | |
|---|---|---|---|
| 2,531,136 | 11/1950 | Kurtz | 62/526 X |
| 2,632,303 | 3/1953 | Smith | 62/526 X |
| 4,439,996 | 4/1984 | Frohbieter | 62/513 X |

*Primary Examiner*—William E. Tapoical

*Attorney, Agent, or Firm*—Patrick R. Scanlon; Paul R. Webb, II

[57] ABSTRACT

A heat transfer arrangement for a refrigeration circuit is described. In one embodiment and for a refrigeration circuit including compressor means, a plurality of evaporator means coupled to the compressor means, one of the evaporator means being arranged to operate at a temperature lower than the operating temperature of the other evaporator means, the present heat transfer arrangement comprises a first conduit means coupled to the outlet of the one evaporator means, the first conduit means being at least partially disposed in a heat transfer arrangement with at least a portion of a second conduit means coupled to the inlet of the one evaporator means.

11 Claims, 8 Drawing Sheets

REFRIGERATION SYSTEM INCLUDING CAPILLARY TUBE/SUCTION LINE HEAT TRANSFER

This application is a continuation of application Ser. No. 07/612,051, filed Nov. 9, 1990, now abandoned.

RELATED APPLICATION

The present application is related to commonly assigned U.S. patent application Ser. No. 07/612,290 entitled "Refrigeration System And Refrigerant Flow Control Apparatus Therefor.

BACKGROUND OF THE INVENTION

1. Field of the Invention

The present invention generally relates to refrigeration systems and, more particularly, relates to heat transfer configurations for refrigeration systems including a plurality of evaporators and a compressor unit.

2. Related Art

In a typical refrigeration system, refrigerant circulates continuously through a closed circuit. The term "circuit", as used herein, refers to a physical apparatus whereas the term "cycle" as used herein refers to operation of a circuit, e.g., refrigerant cycles in a refrigeration circuit. The term "refrigerant", as used herein, refers to refrigerant in a liquid, vapor and/or gas form. Components of the closed circuit cause the refrigerant to undergo temperature/pressure changes. The temperature/pressure changes of the refrigerant result in energy transfer. Typical components of a refrigeration system include, for example, compressors, condensers, evaporators, control valves, and connecting piping. Details with regard to some known refrigeration systems are set forth in Baumeister et al., Standard Handbook for Mechanical Engineers, McGraw Hill Book Company, Eighth Edition, 1979, beginning at page 19-6.

Energy efficiency is one important factor in the implementation of refrigeration systems. Particularly, an ideal refrigeration system provides an ideal refrigeration effect. In practice, an actual refrigeration system provides an actual refrigeration effect less than the ideal refrigeration effect. The actual refrigeration effect provided varies from system to system.

Increased energy efficiency typically is achieved by utilizing more expensive and more efficient refrigeration system components, adding extra insulation adjacent to the area to be refrigerated, or by other costly additions. Increasing the energy efficiency of a refrigeration system therefore usually results in an increase in the cost of the system. It is desirable, of course, to increase the efficiency of a refrigeration system and minimize any increase in cost of the system.

In some apparatus utilizing refrigeration systems, more than one area is to be refrigerated, and at least one area requires more refrigeration than another area. A typical household refrigerator, which includes a freezer compartment and a fresh food compartment, is one example of such an apparatus. The freezer compartment preferably is maintained between −10° Fahrenheit (F.) and +15° F., and the fresh food compartment preferably is maintained between +33° F. and +47° F.

To meet these temperature requirements, a typical refrigeration system includes a compressor coupled to an evaporator disposed within the household refrigerator. The terms "coupled" and "connected" are used herein interchangeably. When two components are coupled or connected, this means that the components are linked, directly or indirectly in some manner in refrigerant flow relationship. Another component or other components can be intervening between coupled or connected components. For example, even though other components such as a pressure sensor or an expander are connected or coupled in the link between the compressor and evaporator, the compressor and evaporator are still coupled or connected.

Referring again to the refrigeration system for a typical household refrigerator, the evaporator is operated so that it is maintained at approximately −10° F. (an actual range of approximately −30° F. to 0° F. typically is used) and air is blown across the coils of the evaporator. The flow of the evaporator-cooled air is controlled, for example, by barriers. A first portion of the evaporator-cooled air is directed to the freezer compartment and a second portion of the evaporator-cooled air is directed to the fresh food compartment. To cool a fresh food compartment, rather than utilizing evaporator-cooled air from an evaporator operating at −10° F., it is possible to utilize an evaporator operating at, for example, +25° F. (or a range of approximately +15° F. to +32° F.). The typical refrigeration system utilized in household refrigerators, therefore, produces its refrigeration effect by operating an evaporator at a temperature which is appropriate for the freezer compartment but lower than it needs to be for the fresh food compartment.

It is well-known that the energy required to maintain an evaporator at −10° F. is greater than the energy required to maintain an evaporator at +25° F. in a refrigerator. The typical household refrigerator therefore uses more energy to cool the fresh food compartment than is necessary. Using more energy than is necessary results in reduced energy efficiency.

The above referenced household refrigerator example is provided for illustrative purposes only. Many apparatus other than household refrigerators utilize refrigeration systems which include an evaporator operating at a temperature below a temperature at which the evaporator actually needs to operate.

Refrigeration systems which reduce energy use are described in commonly assigned U.S. Pat. Nos. 4,910,972 and 4,918,942. The patented systems utilize at least two evaporators and a plurality of compressors or a compressor having a plurality of stages. For example, in a dual, i.e., two, evaporator circuit for household refrigerators, a first evaporator operates at +25° F. and a second evaporator operates at −10° F. Air cooled by the first evaporator is utilized for the fresh food compartment and air cooled by the second evaporator is utilized for the freezer compartment. Utilizing the dual evaporator refrigeration system in a household refrigerator results in increased energy efficiency. Energy is conserved by operating the first evaporator at the temperature (e.g., +25° F.) required for the fresh food compartment rather than operating an evaporator for the fresh food compartment at −10° F. Other features of the patented systems also facilitate increased energy efficiencies.

To drive the plurality of evaporators in the refrigeration systems described in U.S. Pat. Nos. 4,910,972 and 4,918,942, and as mentioned above, a plurality of compressors or a compressor including a plurality of stages are utilized. Utilizing a plurality of compressors or utilizing a compressor having a plurality of stages results in increasing the cost of the refrigeration system over the cost, at least initially, of refrigeration systems utilizing one evaporator and one single stage compressor.

The refrigeration system described in U.S. patent application Ser. No. 07/612,290 provides improved energy efficiency achieved using a plurality of evaporators and minimizes, if not eliminates, the increase in cost associated with using a plurality of compressors or a compressor having a plurality of stages. Particularly, in one embodiment, the refrigeration system described in U.S. patent application Ser. No. 07/612,290 comprises a refrigerant flow control unit and a compressor unit. In the exemplification embodiment, the compressor unit is a single stage compressor. The refrigerant flow control unit is coupled to a plurality of input conduits. Each conduit, in the exemplification embodiment, has refrigerant disposed therein, and each respective refrigerant is at a respective pressure. For example, a first input to the control unit is a high pressure refrigerant and a second input to the control unit is a low pressure refrigerant. The outlet of the refrigerant flow control unit is coupled to the inlet of the compressor unit.

In operation, the respective refrigerants are provided as inputs to the control unit as described above, and the control unit provides that each respective refrigerant flows, alternately, to the compressor unit. The refrigerant flow timing, i.e., the length of time each input refrigerant is allowed to flow to the compressor unit, is determined on a straight timed basis or in accordance with measurable physical attributes, such as the respective pressures, temperatures, densities, and/or flow rates of the respective refrigerants.

In one circuit embodiment, when the freezer evaporator encounters thermal loads which are substantially below design load for example, some unevaporated liquid refrigerant is discharged from the freezer evaporator. The potential cooling capacity of the freezer evaporator, therefore, is decreased under these conditions, yet the amount of work required of the compressor unit is substantially unaffected.

Some of the lost cooling capacity is regained by disposing the conduit, i.e., the suction line, connected to the outlet of the freezer evaporator in a heat transfer arrangement with the conduit connected to the outlet of the condenser. Refrigerant liquid exiting the condenser is further subcooled as a result of the heat transfer arrangement thereby decreasing the enthalpy of the refrigerant before expansion in the fresh food evaporator. This heat transfer effectively shifts the specific cooling capacity, i.e., [(mass flow)×(enthalpy change)], regain from the freezer evaporator to the fresh food evaporator.

It is well known, however, that the mechanical energy required to provide mass flow to the freezer evaporator is greater than the mechanical energy required to provide mass flow to the fresh food evaporator, i.e., more mechanical energy is required to operate an evaporator at a lower temperature. Although the above described heat transfer provides regain of cooling capacity, it would be most desirable if at least some of the cooling capacity regain is provided to the freezer evaporator, thereby decreasing the mechanical energy required to operate the freezer evaporator.

It is an object of the present invention to improve the energy efficiency of a refrigeration system which includes a single compressor unit coupled, directly or indirectly, to a plurality of evaporators.

Another object of the present invention is to provide regain of cooling capacity in an evaporator which operates at a low temperature in a refrigeration system.

Still another object of the present invention is to decrease the mechanical energy required to operate a refrigeration system having a plurality of evaporators.

SUMMARY OF THE INVENTION

The present invention is believed to have greatest utility in refrigeration systems having more than one evaporator, such as a refrigeration system including a fresh food evaporator and a freezer evaporator. More particularly, one embodiment of the present invention comprises disposing a capillary tube, connected to the inlet of the freezer evaporator, in a heat transfer relationship with the freezer evaporator suction line, e.g., a conduit connected between the outlet of the freezer evaporator and the inlet of the compressor unit.

An exemplification refrigeration system having a plurality of evaporators includes a condenser coupled to the outlet of a compressor unit. In this embodiment, the compressor unit is a single-stage compressor. A first evaporator is coupled through a first expansion device to receive the refrigerant discharged from the condenser. The outlet of the first evaporator is coupled to a phase separator which separates refrigerant output from the first evaporator into liquid and vapor. A vapor outlet from the phase separator is coupled to a first inlet of a refrigerant flow control unit. The outlet of the refrigerant flow control unit is coupled to the inlet of the compressor unit. A liquid outlet from the phase separator is coupled to a second expansion device. In the exemplification embodiment, the second expansion device is a capillary tube. The outlet of the capillary tube is coupled to the inlet of a second evaporator. The outlet of the second evaporator is coupled to a second inlet of the refrigerant flow control unit.

In accordance with the present invention, the capillary tube coupled to the inlet of the second evaporator is disposed in a heat transfer relationship with the conduit, i.e., the second evaporator suction line, connecting the outlet of the second evaporator to the second inlet of the refrigerant flow control unit. The capillary tube and the second evaporator suction line preferably are disposed in a counterflow heat exchange arrangement wherein refrigerant flowing in the capillary tube proceeds in a direction opposite to the flow of refrigerant in the second evaporator suction line.

In operation, the refrigerant flow control unit allows refrigerant received at its first and second inlets to alternately flow to the compressor unit. The compressor unit compresses each refrigerant flow to a same pressure. The refrigerant, or at least portions of the refrigerant, circulates through the refrigeration system to bring about energy transfer. For example, the first evaporator operates between +15° F. and +32° F. in order to refrigerate the fresh food compartment to between +33° F. and +47° F. The second evaporator operates between −30° F. and 0° F. in order to refrigerate the freezer compartment to between −10° F. and +15° F.

The heat exchange configuration between the capillary tube and the second evaporator suction line provides a specific cooling capacity increase, or regain, in the second evaporator. The term "specific" means "per unit mass flow rate". The specific cooling capacity increase in the second evaporator also provides that less mechanical energy is required to operate the second evaporator at low temperatures.

BRIEF DESCRIPTION OF THE DRAWINGS

These and other objects of the present invention, together with further features and advantages thereof, will become apparent from the following detailed specification when read together with the accompanying drawings, in which.

DETAILED DESCRIPTION OF THE DRAWINGS

The present invention, as described herein, is believed to have its greatest utility in refrigeration systems and particularly in household refrigerator/freezers. The present invention, however, has utility in other refrigeration applications such as multiple air conditioner units. The term refrigeration systems, as used herein, therefore not only refers to refrigerator/freezers but also to many other types of refrigeration applications.

Figure 1:
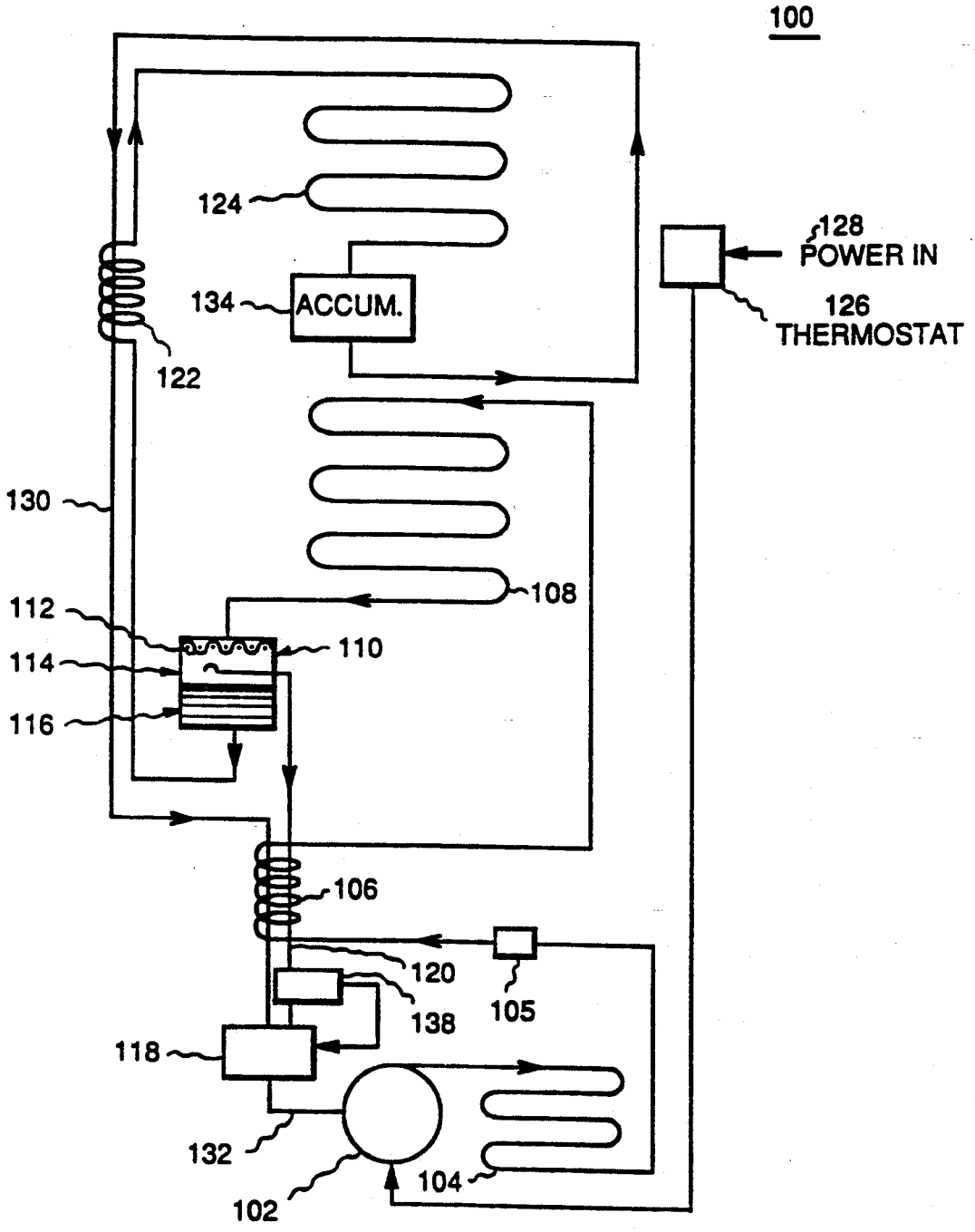
FIG. 1 illustrates a first embodiment of a refrigeration system including a first embodiment of the present heat transfer configuration.

A first embodiment 100 of a refrigeration system is shown in FIG. 1. The system 100 comprises a compressor unit 102 coupled to a condenser 104. A first capillary tube 106 is coupled to the outlet of the condenser 104. Preferably, a filter/dryer 105, known in the art as a "pickle", is disposed in the refrigerant flow path between the condenser 104 and the capillary tube 106. The pickle 105 filters out particulates from the refrigerant and absorbs moisture. A first evaporator 108 is shown coupled to the outlet of the first capillary tube 106. The outlet of the first evaporator 108 is coupled to the inlet of a phase separator 110. The phase separator 110 includes a screen 112 disposed adjacent the phase separator inlet, a vapor portion 114 and a liquid portion 116. The phase separator vapor portion 114 is coupled, as a first input, to a refrigerant flow control unit 118. A conduit 120 extends from the phase separator vapor portion 114 to the control unit 118 and the conduit 120 is arranged within the phase separator 110 so that liquid refrigerant entering the phase separator vapor portion 114 passes through the vapor portion 114 and cannot enter the open end of the conduit 120. The outlet of the phase separator liquid portion 116 is coupled to a second capillary tube 122. A second evaporator 124 is coupled to the outlet of the second capillary tube 122, and the outlet of the second evaporator 124 is coupled, as a second input, to the refrigerant flow control unit 118.

The outlet of the refrigerant flow control unit 118 is coupled to the compressor unit 102. A thermostat 126, which receives current flow from an external power source designated by the legend "POWER IN" 128, is connected to the compressor unit 102. When cooling is required, the thermostat output signal provides for activation of the compressor unit 102. The thermostat 126 typically is disposed in the freezer compartment of the refrigerator. The compressor unit 102 operates only when the thermostat 126 indicates a need for cooling. The configuration of the control unit 118 dictates refrigerant flow through the respective evaporators as hereinafter described.

The evaporators 108 and 124 shown in FIG. 1 preferably are spine fin evaporators which are well known in the art and the compressor unit 102 preferably is a rotary type compressor. The evaporators 108 and 124, for example, are disposed in the fresh food compartment and the freezer compartment, respectively, of a household refrigerator. The evaporators 108 and 124 preferably are positioned so that gravity forces drain any excess liquid refrigerant out of the evaporators.

The subject matter of the present invention is specifically directed to the heat transfer configuration shown, as one embodiment, between the second capillary tube 122 and the conduit 130, i.e., the suction line of the second evaporator 124. The second capillary tube 122 is disposed in a counterflow heat transfer arrangement with the conduit 130. More specifically, the second capillary tube 122 is in thermal contact with the conduit 130. Thermal contact is achieved, for example, by soldering the exterior of the capillary tube 122 and a portion of the conduit 130 together side-by-side. The capillary tube 122 is shown as being wrapped around the conduit 130 as a schematic representation of a heat transfer relationship. As hereinbefore described, the heat transfer occurs in a counterflow arrangement, i.e., the refrigerant flowing in the capillary tube 122 proceeds in a direction opposite to the flow of refrigerant in the conduit 130. As is well known in the art, using a counterflow heat exchange arrangement, rather than a heat exchange arrangement wherein the flows proceed in a same direction, increases the heat exchange efficiency. Further details with regard to the advantages obtained with the present heat transfer configuration are provided with respect to FIGS. 4A and B. It is contemplated that the capillary tube 122, in another embodiment (not shown), is disposed so that the flows through the capillary tube 122 and the conduit 130 proceed in the same direction.

The first capillary tube 106 is disposed in a counterflow heat exchange arrangement with the conduits 120 and 130. Thermal contact is achieved, for example, by soldering the exterior of the capillary tube 106 and a portion of the exterior of the conduits 120 and 130 together side-by-side. The capillary tube 106 is shown as being wrapped around the conduits 120 and 130 as a schematic representation of a heat transfer relationship. The heat transfer occurs in a counterflow arrangement, i.e., the refrigerant flowing in the capillary tube 106 proceeds in a direction opposite to the flow of refrigerant in the conduits 120 and 130.

In addition to the above components, the system 100 includes an accumulator 134. The accumulator 134 is disposed at the exit of the second evaporator 124 and within the freezer compartment. A pressure sensor 138 also is illustrated in FIG. 1. The pressure sensor 138 is disposed in a position to generate a signal representative of the pressure of refrigerant flowing in the conduit 120 and between the capillary tube 106 and the conduit 120 heat exchange arrangement and the control unit 118. The output signal from the pressure sensor 138 is used to control operation of the control unit 118 as hereinafter described.

Figure 2:
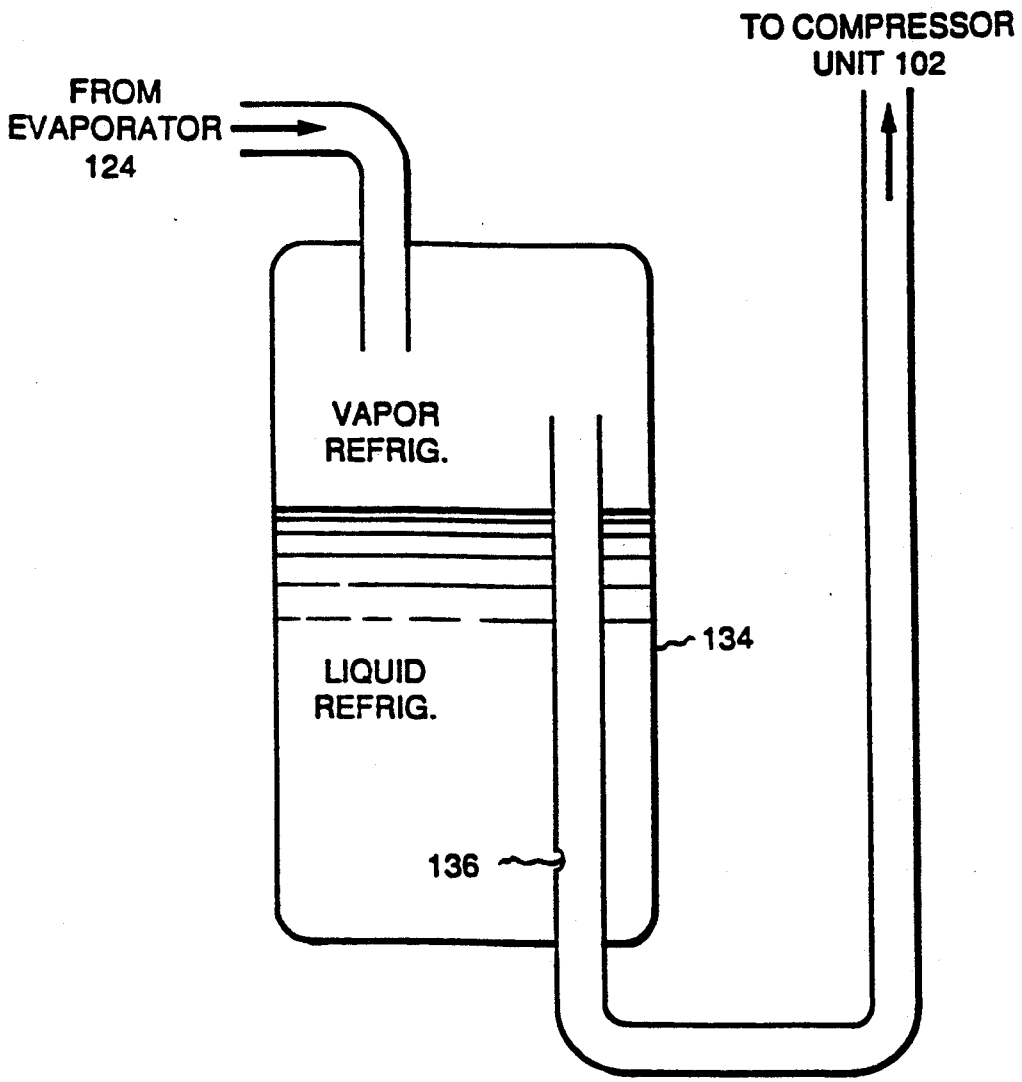
FIG. 2 illustrates, in more detail, the accumulator used in the embodiment of the refrigeration system illustrated in FIG. 1.

Referring now to FIG. 2, a more detailed view of the accumulator 134 is shown. The accumulator 134 receives refrigerant discharged from the second evaporator 124 and supplies vapor refrigerant to the compressor unit 102, via the control unit 118. An internal transport line bleeder hole 136 is provided to prevent lubricant hold-up when cycle conditions change, e.g., when superheated vapor is discharged from the second evaporator 124.

When the second evaporator 124 operates at lower than specification temperatures, such as due to decreased thermal load or due to compartment thermostat setting for example, some liquid is discharged from the second evaporator 124. The accumulator 134 prevents a loss of cooling capacity which would result from evaporation, in the conduit 130, of liquid discharged from the second evaporator 124. Particularly, liquid discharged from the second evaporator 124 is stored in the accumulator 134. Vapor discharged from the second evaporator 124 passes through the conduit 130. When refrigerant flowing from the second evaporator 124 is superheated, then the refrigerant liquid stored within the accumulator 134 is evaporated in the accumulator 134 and passes through the conduit 130. In this manner, the accumulator 134 facilitates preventing a loss of the cooling capacity of the second evaporator 124.

Figure 3:
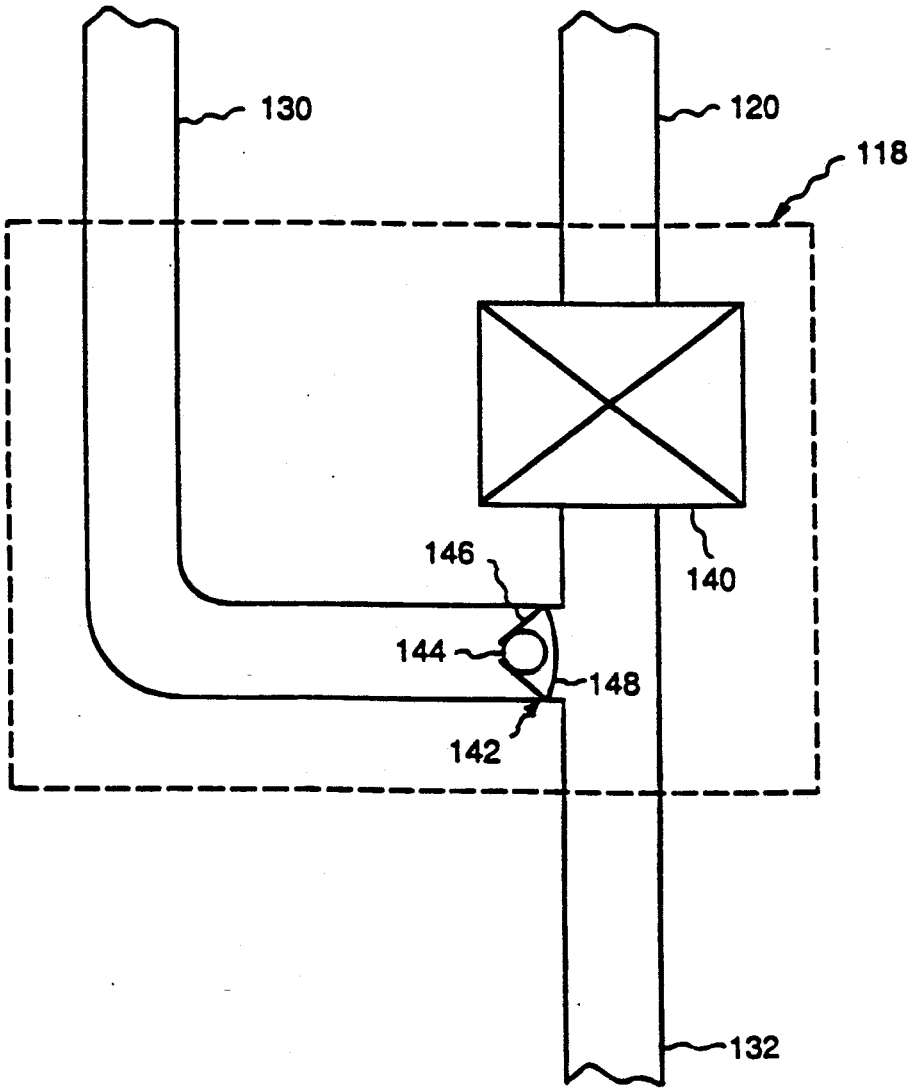
FIG. 3 illustrates, in more detail, an embodiment of the refrigerant flow control unit used in the embodiment of the refrigeration system illustrated in FIG. 1.

The flow control unit 118 is schematically shown in more detail in FIG. 3. The two input conduits 120 and 130 are integrally formed with the control unit 118. The output conduit 132 also is shown integrally formed with the control unit 118. The input conduits 120 and 130 and the output conduit 132, rather than being integrally formed with the unit 118, in another embodiment (not shown) are coupled to inlets and an outlet, respectively, of the unit 118 such as by welding, soldering, mechanical couplers, etc. The control unit 118 includes a controllable valve 140 which comprises a solenoid operated valve. A solenoid controlled valve is available, for example, from ISI Fluid Power Inc., Fraser, Mich. The valve from ISI Fluid Power Inc. is modified by removing the housing gaskets and hermetically sealing the housing for use with refrigerants. The controllable valve 140 is used for controlling fluid flow through the input conduit 120 which typically carries a higher pressure refrigerant than the conduit 130. A check valve 142 is disposed within the input conduit 130. The check valve 142 includes a ball 144, a seat 146, and a cage 148.

In operation, timing for the opening and closing of the controllable valve 140 is provided via the pressure sensor 138 (FIG. 1). Timed power output from the pressure sensor 138 to the solenoid of the controllable valve 140 is determined by the pressure of the refrigerant in the conduit 120. When the valve 140 is closed, the low pressure refrigerant in the conduit 130 forces the check valve 142 open and the low pressure refrigerant flows from the conduit 130 to the output conduit 132. This condition is referred to herein as STATE 1. When the valve 140 opens thereby allowing refrigerant to flow therethrough, the high pressure refrigerant from the conduit 120 causes the check valve 142 to close and remain closed while the high pressure refrigerant is flowing from the conduit 120 to the output conduit 132. This condition is referred to herein as STATE 2.

More particularly, in operation and using, for example, the refrigerant R-12 (dichlorodifluoromethane), refrigerant at about 20 pounds per square inch absolute (psia) is disposed in the conduit 130 and refrigerant at about 40 psia is disposed in the conduit 120. The inlet pressure to the compressor unit 102 when the control unit 118 is in STATE 1 is approximately 20 psia. When the control unit 118 is in STATE 2, the compressor unit inlet pressure is approximately 40 psia.

The pressure switch 138 is used to control the particular state or configuration of the control unit 118. For example, if it is preferred to maintain the refrigerant in the first evaporator 108 at approximately +34° F., a temperature range of approximately +26° F. to +36° F. is a suitable range for the temperature of the refrigerant in the first evaporator 108. By sensing the pressure of the refrigerant in the conduit 120 close to the flow control unit 118, as illustrated by the location of the pressure sensor 118 in FIG. 1, there is a one-to-one correspondence between the sensed pressure and the temperature of refrigerant in the first evaporator 108. When the pressure sensor by the pressure sensor 138 indicates that the temperature of refrigerant in the first evaporator is above +36° F., the pressure sensor output signal activates the control unit 118, such as by activating the controllable valve 140, so that flow communication is established between the conduit 120 and the conduit 132, i.e., STATE 2.

Although flow communication is established between the conduits 120 and 132, refrigerant will be pulled through the first evaporator 108 only when the thermostat 126 has detected a need for cooling in the freezer compartment thereby activating the compressor unit 102. For example, when it is preferred to maintain the freezer compartment air temperature at approximately 0° F., a temperature range of −2° F. to +2° F. is a typical range for the air temperature of the freezer compartment. When the air temperature of the freezer compartment is above +2° F., the thermostat 126 provides that power is supplied to the compressor unit 102. Subsequent to activation of the compressor unit 102, once the air temperature of the freezer compartment is below −2° F., the thermostat 126 cuts-off power to the compressor unit 102. When the compressor unit 102 is not activated, regardless of the configuration of the control unit 118, substantially no refrigeration effect is provided to the fresh food compartment and the freezer compartment.

When the temperature of refrigerant in the conduit 120 is above +36° F. and the temperature of the freezer compartment is above +2° F., the control unit 118 is disposed in STATE 2 and the compressor unit 102 is activated. Once the temperature of refrigerant within the fresh food compartment evaporator 108 is brought to below +26° F., then the pressure sensor 138 causes the control unit 118 to transition into STATE 1. Refrigerant will then be pulled through the freezer evaporator 124 until the temperature of the freezer compartment is below −2° F. Even when the control unit 118 is in STATE 1, the fresh food evaporator 108 has refrigerant pulled therethrough albeit at a rate slower than the rate when the control unit 118 is in STATE 2. In order for the freezer evaporator 124 to have refrigerant pulled therethrough, the temperature of the refrigerant in the conduit 120 must be below +36° F. and the temperature of the freezer compartment must be above +2° F.

The system 100 illustrated and described above was implemented in a General Electric Company Household Refrigerator Model No. TBX25Z with a General Electric Company No. 800 Rotary-type compressor. For compressor unit cycling, the on-period was found to be 22.7 minutes and the off-period was found to be 33.5 minutes (40.4% on-time). Respective evaporator fans (not shown) were provided to blow air across the coils of each evaporator. Each fan was coupled through the thermostat 126 to the power supply, and when the thermostat 126 activated the compressor unit 102, both fans also were activated and blew air across its respective evaporator 108 and 124.

Figure 4A:
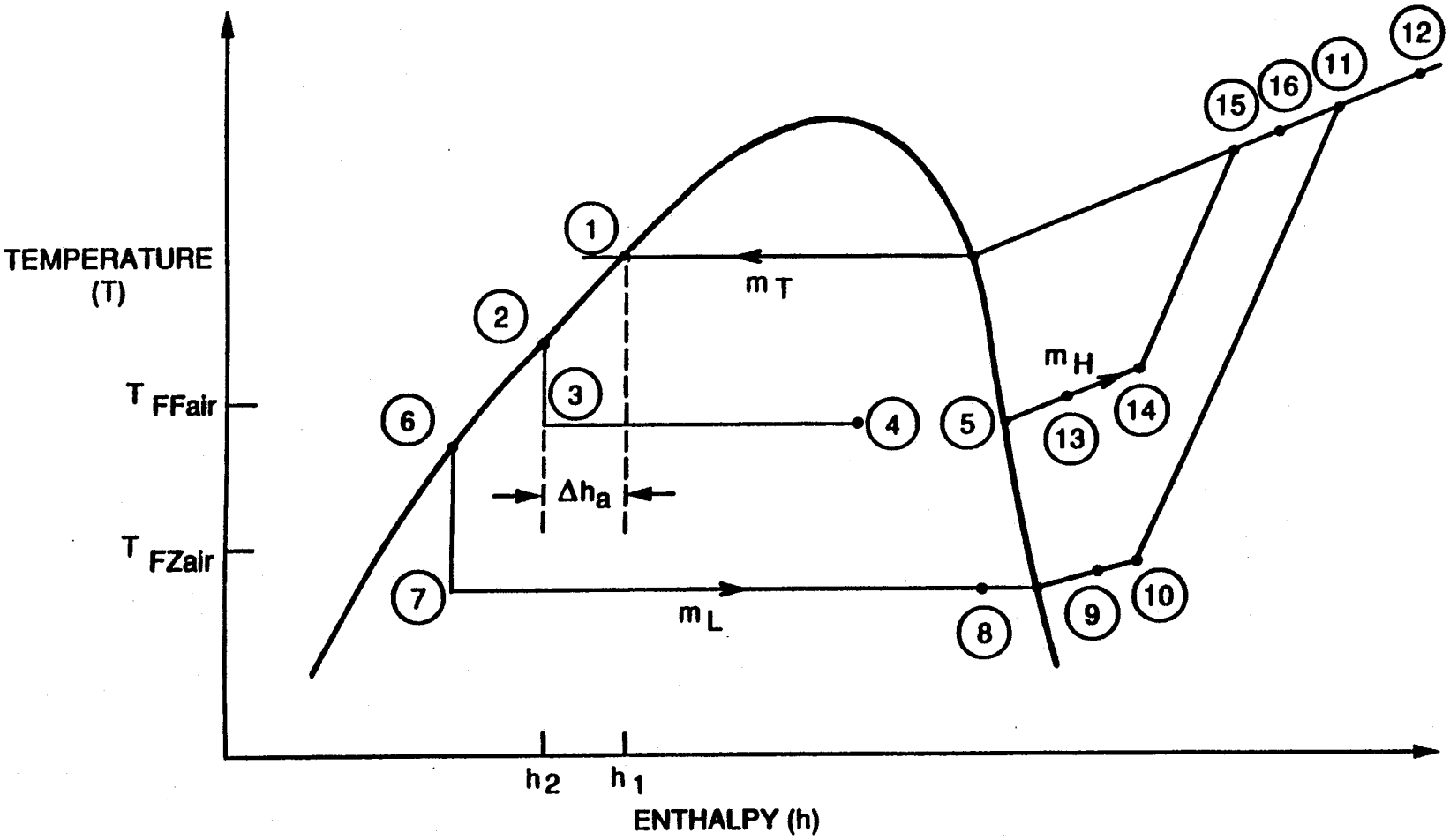
FIGS. 4A–B, respectively, illustrate temperature-enthalpy diagrams for a refrigeration circuit not having the present heat transfer configuration and for the refrigeration circuit illustrated in FIG. 1 which includes the present heat transfer configuration, respectively.
Figure 4B:
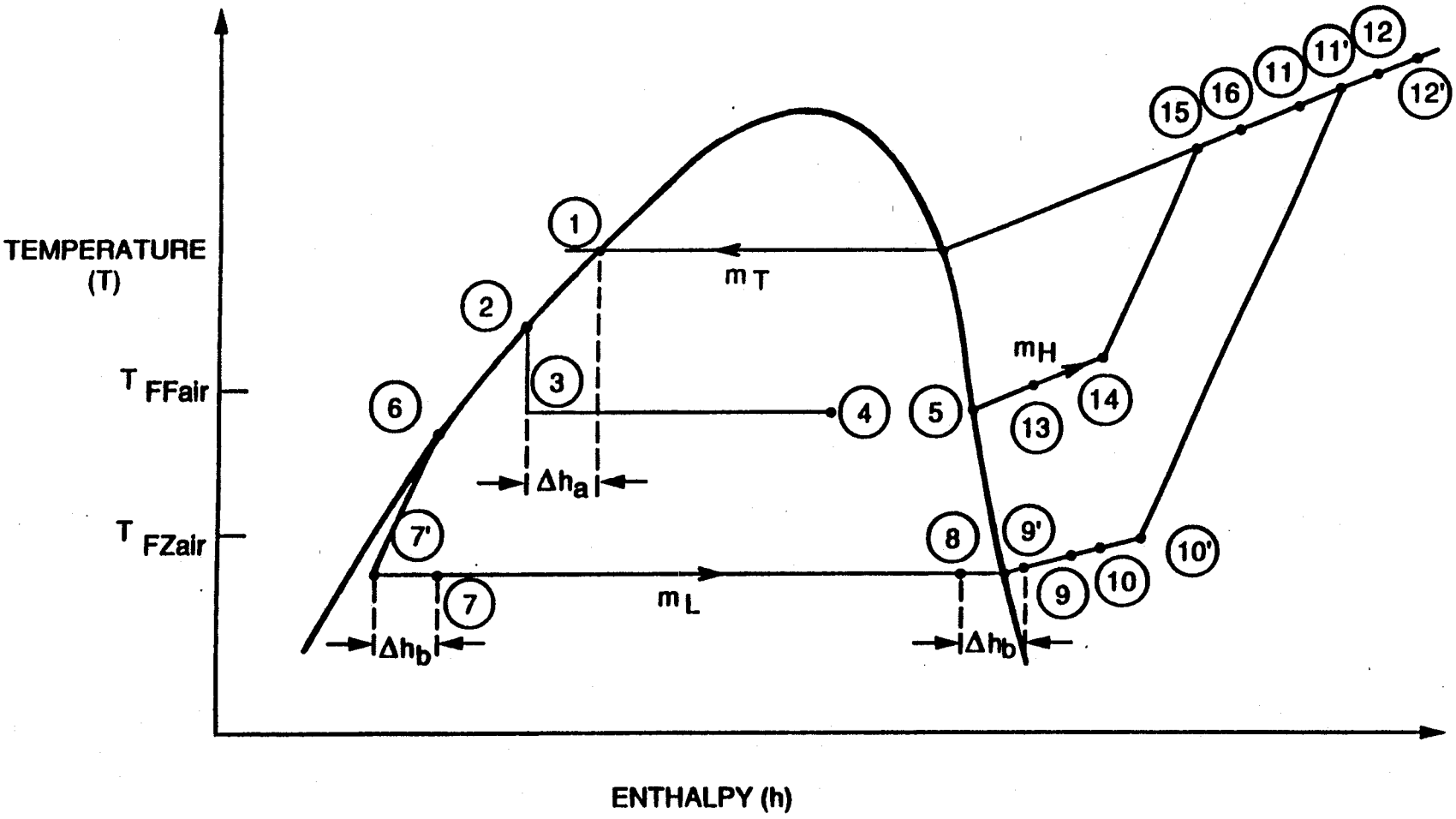

FIGS. 4A–B, respectively, illustrate temperature-enthalpy diagrams. The diagram for FIG. 4A is for a refrigeration circuit similar to the circuit 100 illustrated in FIG. 1 but not having the capillary tube 122 and the conduit 130 disposed in a heat transfer configuration. The diagram in FIG. 4B is for the refrigeration circuit 100 illustrated in FIG. 1 which, as shown, includes one embodiment of the present heat transfer configuration, i.e., the capillary tube 122 and the conduit 130 are disposed in a heat transfer configuration.

More particularly, and referring to FIG. 4A, the x-axis corresponds to enthalpy (h) and the y-axis corresponds to temperature (T). Again, the circuit under analysis in FIG. 4A corresponds to the circuit shown if FIG. 1 with the exception that the capillary tube 122 and the conduit 130, i.e., the freezer evaporator suction line, are not disposed in a heat transfer relationship. On the y-axis, the temperature of air in the fresh food evaporator $T_{FFair}$ and the temperature of air in the freezer evaporator $T_{FZair}$ are indicated. Point 1 on the diagram illustrates the state of refrigerant at the exit of the condenser 104. Point 2 illustrates the state of refrigerant still within the capillary tube 106 but at the end of thermal contact with the conduits 120 and 130. Point 3 illustrates the state of refrigerant between the outlet of the capillary tube 106 and the inlet of the first evaporator 106. Point 4 illustrates the state of refrigerant at the outlet of the first evaporator 106. Point 5 illustrates the state of the refrigerant at the outlet of the phase separator vapor portion 114. Point 6 illustrates the state of the refrigerant at the outlet of the phase separator liquid portion 116. Point 7 illustrates the state of the refrigerant at the outlet of the capillary tube 122 (again, the capillary tube 122, in this exemplification, is not in a heat transfer relationship with the conduit 130). Point 8 illustrates the state of the refrigerant at the outlet of the accumulator 134. Point 9 illustrates the state of the refrigerant within the conduit 130 at the end of thermal contact with the capillary tube 106. Point 10 illustrates the state of the refrigerant from the conduit 130 at the inlet to the compression chamber of the compressor unit 102. Point 11 illustrates the state of the refrigerant from the conduit 130 at the outlet of the compression chamber of the compressor unit 102. Point 12 illustrates the state of the refrigerant from the conduit 130 at the outlet of the compressor motor chamber of the compressor unit 102. Point 13 illustrates the state of refrigerant in the conduit 120 at the end of thermal contact with the capillary tube 106. Point 14 illustrates the state of the refrigerant from the conduit 120 at the inlet of the compression chamber of the compressor unit 102. Point 15 illustrates the state of the refrigerant from the conduit 120 at the outlet of the compression chamber of the compressor unit 102. Point 16 illustrates the state of the refrigerant from the conduit 120 at the outlet of the compressor motor chamber of the compressor unit 102.

The temperature-enthalpy diagram in FIG. 4A is provided to facilitate an understanding of the thermodynamic advantages provided by the present invention. Particularly, a comparison of the diagrams in FIGS. 4A and 4B illustrates the specific cooling capacity increase, or regain, in the freezer evaporator provided by the present invention.

More specifically, the circuit under analysis in FIG. 4B corresponds to the circuit shown if FIG. 1 which, as illustrated, includes one embodiment of the present invention, i.e., the heat transfer configuration of the capillary tube 122 and the conduit 130. The points and corresponding numerals indicated in FIG. 4A are included in FIG. 4B to facilitate a comparison of the thermodynamic characteristics. On the y-axis, the temperature of air in the fresh food evaporator $T_{FFair}$ and the temperature of air in the freezer evaporator $T_{FZair}$ are indicated. Point 1 on the diagram illustrates the state of refrigerant at the exit of the condenser 104. Point 2 illustrates the state of refrigerant within the capillary tube 106 at the end of thermal contact with the conduits 120 and 130. Point 3 illustrates the state of refrigerant between the outlet of the capillary tube 106 and the inlet of the first evaporator 106. Point 4 illustrates the state of refrigerant at the outlet of the first evaporator 106. Point 5 illustrates the state of the refrigerant at the outlet of the phase separator vapor portion 114. Point 6 illustrates the state of the refrigerant at the outlet of the phase separator liquid portion 116.

Point 7' illustrates the state of the refrigerant at the outlet of the capillary tube 122 (note that the capillary tube, in this exemplification, is in a heat transfer relationship with the conduit 130). Point 8 illustrates the state of the refrigerant at the outlet of the accumulator 134. Point 9' illustrates the state of the refrigerant within the conduit 130 at the end of thermal contact with the capillary tube 106. Point 10' illustrates the state of the refrigerant from the conduit 130 at the inlet to the compression chamber of the compressor unit 102. Point 11' illustrates the state of the refrigerant from the conduit 130 at the outlet of the compression chamber of the compressor unit 102. Point 12' illustrates the state of the refrigerant from the conduit 130 at the outlet of the compressor motor chamber of the compressor unit 102. Point 13 illustrates the state of refrigerant in the conduit 120 at the end of thermal contact with the capillary tube 106. Point 14 illustrates the state of the refrigerant from the conduit 120 at the inlet of the compression chamber of the compressor unit 102. Point 15 illustrates the state of the refrigerant from the conduit 120 at the outlet of the compression chamber of the compressor unit 102. Point 16 illustrates the state of the refrigerant from the conduit 120 at the outlet of the compressor motor chamber of the compressor unit 102.

The present heat transfer configuration provides for a specific cooling capacity increase in the freezer evaporator 124. The increase in specific cooling capacity results in a decrease in the amount of mechanical energy required to cool the freezer evaporator. The cooling capacity increase which actually results in practice, of course, depends upon the actual mass flow rate through the freezer evaporator. More particularly, and referring to FIG. 4A, the mass flow rates m are designated as follows:

$m_T$=total mass flow rate;

$m_L$ = mass flow rate through the freezer evaporator 124; and $m_H$ = mass flow rate through the fresh food evaporator 108.

Then, for the FIG. 4A system, $$(m_T)(\Delta h_a) = m_L(h_9 - h_8) + m_H(h_{13} - h_5), \text{ where } \Delta h_a = h_1 - h_2. \quad (1)$$

Enthalpy (h) is associated with respective mass flow rates in order to provide specific cooling capacity. Equation 1 states that the change in enthalpy ($\Delta h_a$) of refrigerant from the entrance to the exit of the capillary tube 106, which enthalpy change ($\Delta h_a$) results from the heat transfer between the capillary tube 106 and the conduits 120 and 130, equals the change in enthalpy of the refrigerant in the conduits 120 and 130 from the beginning to the end of thermal contact with the capillary tube 106. As a result of the heat transfer, the specific cooling capacity regain in the fresh food evaporator 108 is equal to $[(m_H)(\Delta h_a)]$. There is no specific cooling capacity regain in the freezer evaporator 124 as a result of the heat transfer with the capillary tube 106.

When the heat transfer of the present invention is utilized, as illustrated in FIG. 4B, then Equation 1 becomes:

$$(m_T)(\Delta h_a) = m_L(h_{9'} - h_8) + m_H(h_{13} - h_5), \text{ where } \Delta h_b = (h_{9'} - h_8). \quad (2)$$

If $Q_L$ is equal to the cooling supply to the freezer compartment, then without the present heat transfer configuration, i.e., for the FIG. 4A diagram:

$$Q_L = m_L(h_8 - h_7). \quad (3)$$

With the present heat transfer configuration, however, the cooling supply $Q_{L'}$ of the freezer compartment, as illustrated in FIG. 4B, is:

$$Q_{L'} = m_L(h_8 - h_{7'}). \quad (4)$$

The present invention, therefore, provides an increase in the specific cooling capacity of the freezer evaporator 124 by addition of $m_L(h_7 - h_{7'})$. The actual cooling capacity increase, of course, depends upon the mass flow rate of refrigerant flowing through the freezer evaporator 124. The increase in cooling capacity also provides that less mechanical energy is required to cool the freezer compartment. Specifically, the compressor unit operating time required to satisfy the cooling demand of the freezer compartment is reduced because the cooling supplied by the freezer evaporator 124 is increased during operation.

Figure 5:
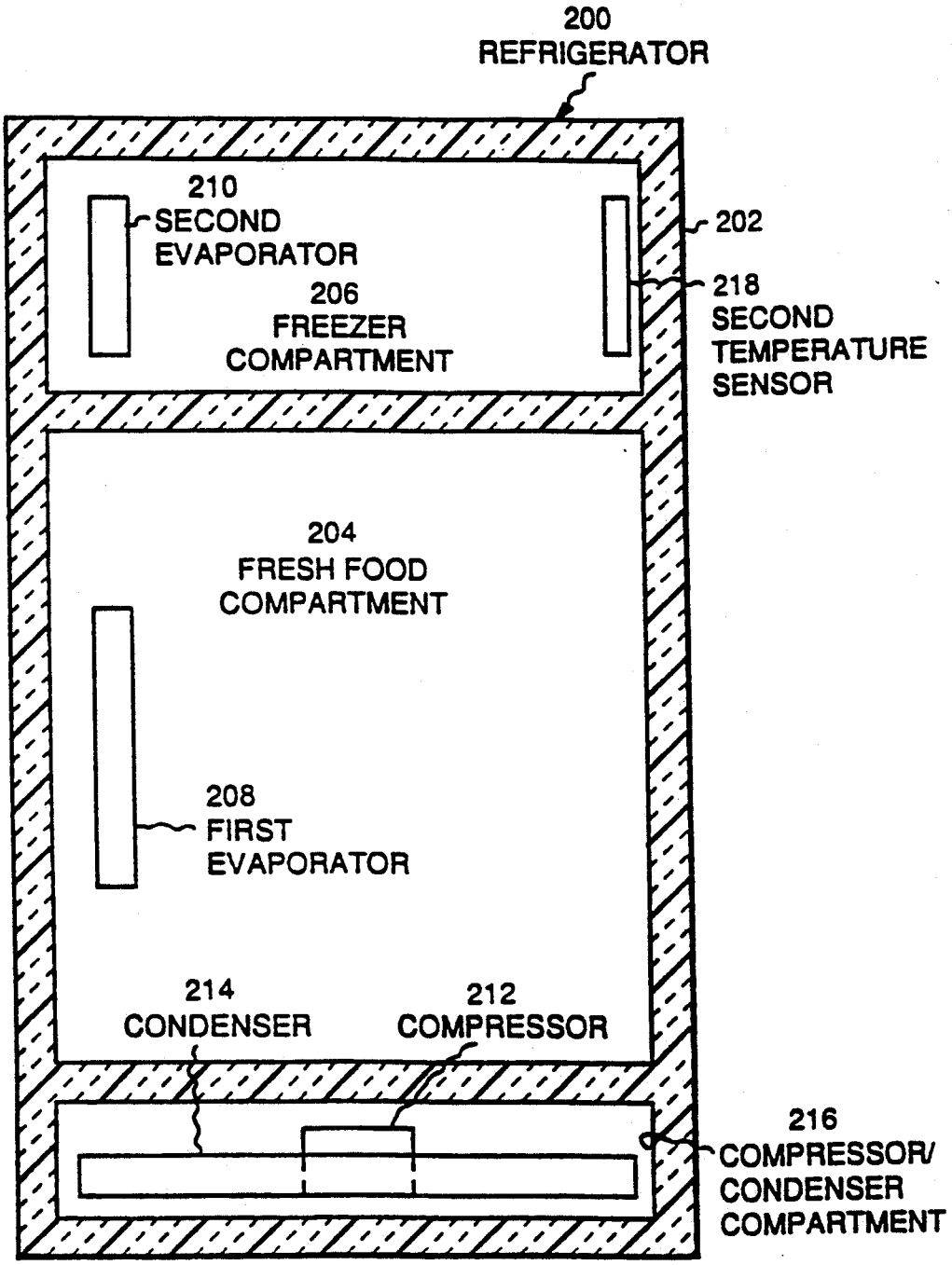
FIG. 5 is a block diagram illustration of a household refrigerator.

FIG. 5 is a block diagram illustration of a household refrigerator 200 including an insulated wall 202 forming a fresh food compartment 204 and a freezer compartment 206. FIG. 4 is provided for illustrative purposes only, and particularly to show one apparatus which has substantially separate compartments which require refrigeration at different temperatures. In the household refrigerator, the fresh food compartment 204 and the freezer compartment 206 typically are maintained at about +33° F. to +47° F. and −10° F. to +15° F., respectively.

A first evaporator 208 is shown disposed in the fresh food compartment 204 and a second evaporator 210 is shown disposed in the freezer compartment 206. The present invention is not limited to the physical location of the evaporators, and the location of the evaporators shown in FIG. 5 is only for illustrative purposes and to facilitate ease of understanding. It is contemplated that the evaporators 208 and 210 could be disposed anywhere in the household refrigerator, or even outside the refrigerator and the evaporator-cooled air from each respective evaporator is directed to the respective compartments via conduits, barriers, and the like.

The first and second evaporators 208 and 210 are driven by a compressor unit 212 and a condenser 214 shown located in a compressor/condenser compartment 216. A temperature sensor 218, such as the thermostat 126 shown in FIG. 1, is disposed in the freezer compartment 206. The sensor 218, of course, preferably is user adjustable so that a system user selects a temperature, or temperature range, at which the compressor is to be activated and/or inactivated. The first evaporator 208 typically is operated at between approximately +15° F. to approximately +32° F. and the second evaporator 210 typically is operated at approximately −30° F. to approximately 0° F. in order to maintain the fresh food compartment 204 at between approximately +33° F. to +47° F. and the freezer compartment 206 between approximately −10° F. to +15° F., respectively.

Figure 6:
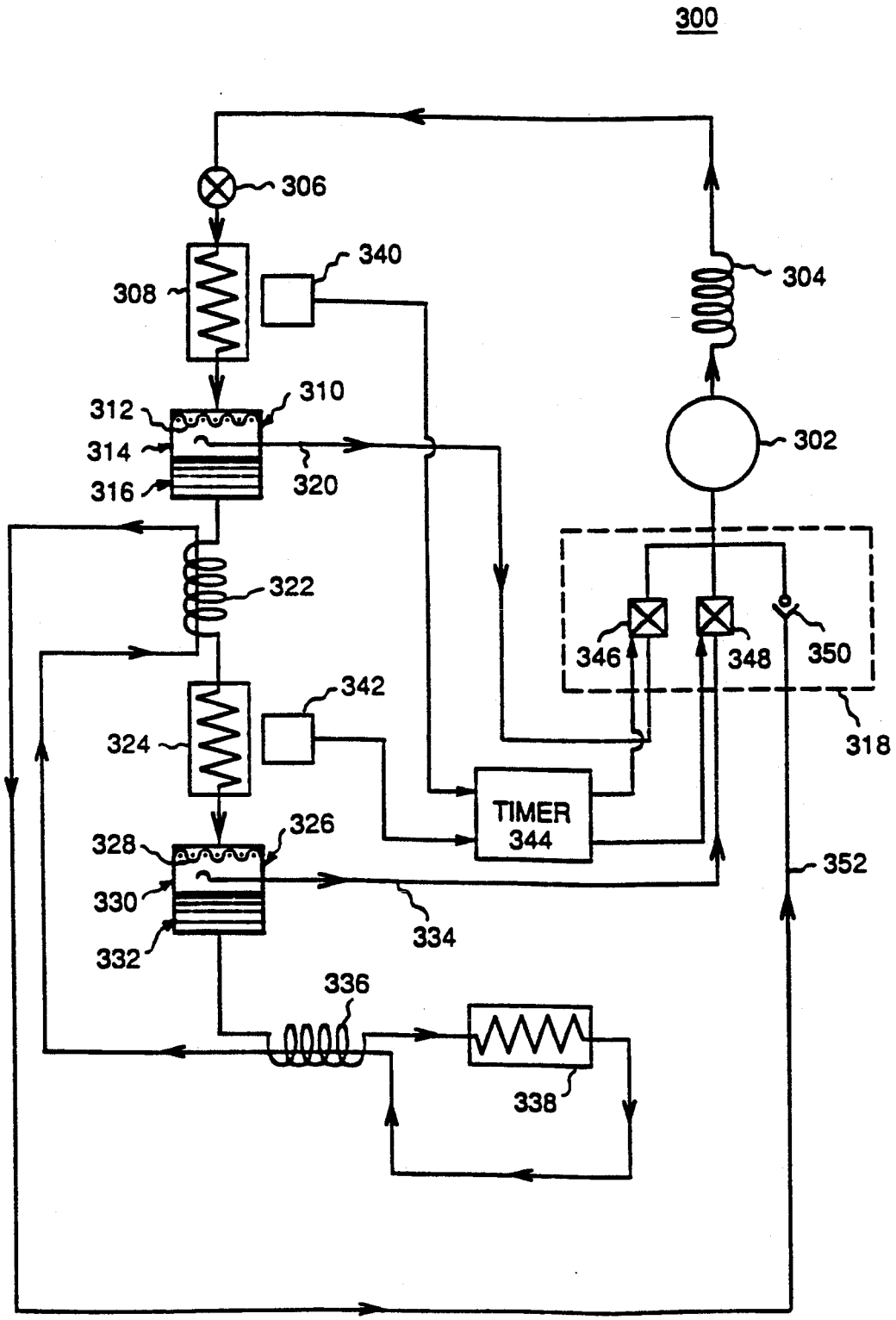
FIG. 6 illustrates a second embodiment of a refrigeration system including a second embodiment of the present heat transfer configuration.

FIG. 6 illustrates a second embodiment of the present invention wherein more than two evaporators are utilized. More than two evaporators provide even further efficiencies in some contexts. For example, in some contexts, it is desired to provide a household refrigerator with a third evaporator to quickly chill or freeze selected items in a separate compartment.

Particularly, embodiment 300 includes a compressor unit 302 coupled to a condenser 304. The outlet of the condenser 304 is coupled to a first expansion valve 306 which has its outlet coupled to a first evaporator 308. The outlet of the first evaporator 308 is coupled to the inlet of a first phase separator 310. The first phase separator 310 includes a screen 312, a vapor portion 314 and a liquid portion 316. The phase separator vapor portion 314 is coupled, as a first input, to a refrigerant flow control unit 318. Particularly, a conduit 320 extends from the first phase separator vapor portion 314 to the control unit 318 and the conduit 320 is arranged within the phase separator 310 so that liquid refrigerant entering the phase separator vapor portion 314 passes through the vapor portion 314 and cannot enter the open end of the conduit 320. The outlet of the first phase separator liquid portion 316 is coupled to a first capillary tube 322. A second evaporator 324 is coupled to the outlet of the first capillary tube 322, and the outlet of the second evaporator 324 is coupled to the inlet of a second phase separator 326. The second phase separator 326 includes a screen 328, a vapor portion 330 and a liquid portion 332. The phase separator vapor portion 330 is coupled, as a second input, to the refrigerant flow control unit 318. Particularly, a conduit 334 extends from the second phase separator vapor portion 330 to the control unit 318 and the conduit 334 is arranged within the phase separator 326 so that liquid refrigerant entering the phase separator vapor portion 330 passes through the vapor portion 330 and cannot enter the open end of the conduit 334. The outlet of the second phase separator liquid portion 332 is coupled to a second capillary tube 336. A third evaporator 338 is coupled to the outlet of the second capillary tube 336, and the outlet of the third evaporator 338 is coupled, as a third input, to the refrigerant flow control unit 318.

First and second sensors 340 and 342 for example, are utilized for detecting physical attributes of the first and second evaporators 308 and 324, respectively, or to detect physical attributes of refrigerant flowing through the respective evaporators. For example, the sensors 340 and 342 are temperature, pressure, flow rate, and/or density-type sensors. Respective pressure sensors, for example, are connected anywhere along the length of the evaporators 308 and 324 such as at respective evaporator outlets. Respective temperature sensors preferably are placed at a location along the length of respective evaporators where two-phase refrigerant flows. The first and second sensors 340 and 342 are coupled to a timer 344. The timer 344 is a variable timer. Rather than the timer 344, a sensor switch can be utilized. Also, a fixed timer can be used to drive the control unit 318. With the fixed timer, of course, the sensors 340 and 342 are not necessary. The sensors 340 and 342 preferably are user adjustable.

The control unit 318 shown in FIG. 6 comprises first and second controllable valves 346 and 348. Particularly, the valves 346 and 348 preferably are on-off solenoid valves which are well-known in the art. The control unit 318 further comprises a check valve 350. The first and second controllable valves 346 and 348 receive, as inputs, refrigerant flowing through the conduits 320 and 334, respectively. The conduit 352, which is coupled to the third evaporator, provides input refrigerant to the check valve 350.

In operation, each valve of the control unit 318 alternately opens to allow refrigerant to flow through the respective evaporators to the compressor unit 302. For example, when the first valve 346 is open and the valve 348 is closed, refrigerant flows through the first evaporator 308 to the phase separator 310 and to the compressor unit 302 via the conduit 320. Refrigerant does not flow through the second or third evaporators 324 and 338 at this time.

Similarly, when the first valve 346 is closed and the second valve 348 is open, refrigerant flows from the liquid portion 314 of the phase separator 310, through the expansion device 322, through the second evaporator 324, to the phase separator 326, and to the compressor unit 302 via the conduit 334. Vapor refrigerant does not flow from the first phase separator 310 or from the third evaporator 338 to the compressor unit 302 at this time. Refrigerant flows through the first evaporator 308 from the condenser 304 at this time.

When both the valves 346 and 348 are closed, the third valve 350 automatically opens and liquid refrigerant flows from the second phase separator liquid portion 332, through the expansion device 336, though the third evaporator 338, and to the compressor unit 302. Refrigerant also flows through the first evaporator 308 and the second evaporator 324 at this time.

Relative to each other, a higher pressure refrigerant flows through the conduit 320, a medium pressure refrigerant flows through the conduit 334, and a lower pressure refrigerant flows through the conduit 350. The timer 344 controls the duty cycle of the control unit 318. The specific duty cycle selected depends, of course, upon the desired operating parameters of each evaporator. It will be understood that the timer 344 controls the valves 346 and 348 so that they open alternately or are both closed, but they are not concurrently open. A thermostat (not shown), of course, normally is provided to control activation of the compressor unit 302.

The first evaporator 308 operates at a temperature higher than the operating temperatures of the second and third evaporators 310 and 338. The third evaporator 338 operates at a temperature lower than the operating temperatures of the first and second evaporators 310 and 326. The second evaporator 310 operates at a temperature intermediate the operating temperatures of the first and third evaporators 308 and 338.

In accordance with the present invention, the conduit 352, i.e., the suction line of the third evaporator 338, is disposed in a counterflow heat transfer arrangement with the second capillary tube 336 and with the first capillary tube 322. This embodiment of the present invention provides for regain of specific cooling capacity in the third evaporator 338 in a manner similar to the regain in specific cooling capacity as described with reference to the embodiment of the present invention illustrated in FIG. 1. In the FIG. 6 embodiment, however, additional specific cooling capacity is potentially regained by disposing the conduit 352 in counterflow heat transfer arrangements with both the first capillary tube 322 and the second capillary tube 336.

Figure 7:
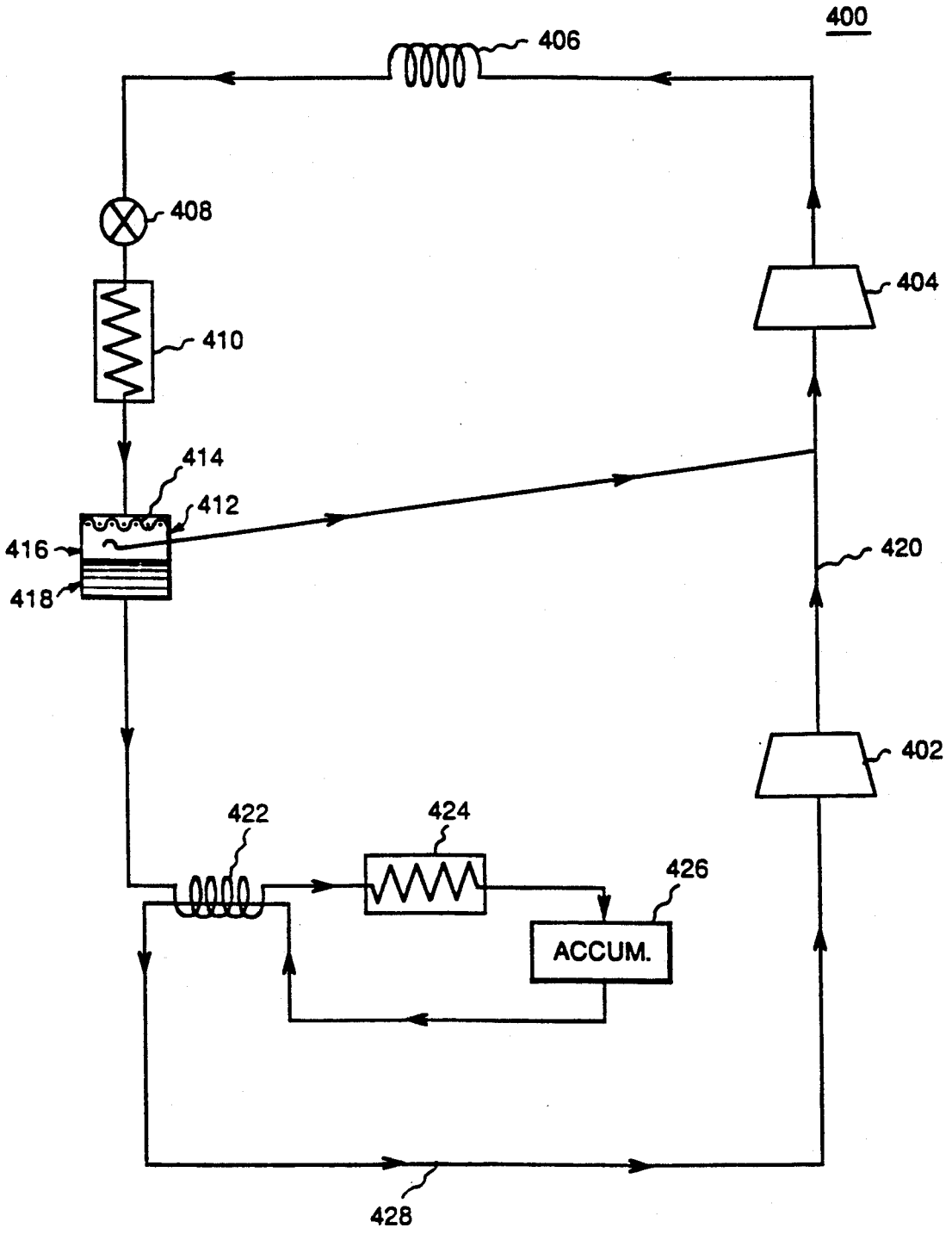
FIG. 7 illustrates a third embodiment of a refrigeration system including a third embodiment of the present heat transfer configuration.

FIG. 7 illustrates a third embodiment of a refrigeration system 400 including a third embodiment of the present heat transfer configuration. Particularly, in FIG. 7, the refrigeration system 400 comprises a first compressor unit 402 and a second compressor unit 404, the outlet of the first compressor unit 402 being connected to the inlet of the second compressor unit 404. A first capillary tube 406 is coupled to the outlet of the second compressor unit 404, and the outlet of the first capillary tube 406 is coupled to the inlet of a first expansion device 408. The outlet of the first expansion device 408 is coupled to the inlet of the first evaporator 410, and the outlet of the first evaporator 410 is coupled to the inlet of a phase separator 412. The phase separator 412 includes a screen 414 disposed adjacent the phase separator inlet, a vapor portion 416 and a liquid portion 418. The outlet of the vapor portion 416 is connected to the conduit 420 disposed between and coupling the first compressor unit 402 and the second compressor unit 404. The liquid portion 418 is connected to a second capillary tube 422. The outlet of the second capillary tube 422 is connected to the inlet of a second evaporator 424. The outlet of the second evaporator 424 is connected to an accumulator 426, and the outlet of the accumulator 426 is connected to the inlet of the first compressor unit 402 via the conduit 428. The accumulator 426 operates in a manner similar to operation of the accumulator 134 illustrated in FIG. 1. Particularly, the accumulator 426 is identical to the accumulator 134 illustrated in more detail in FIG. 2. Liquid refrigerant discharged from the second evaporator 424 is stored within the accumulator 426 until the liquid refrigerant is evaporated such as by superheated refrigerant being discharged from the second evaporator 124.

This embodiment of the present invention provides for regain of specific cooling capacity in the second evaporator 424 in a manner similar to the regain in specific cooling capacity as described with reference to the embodiment of the present invention illustrated in FIG. 1. Particularly, by disposing the conduit 428 in a counterflow heat transfer arrangement with the capillary tube 422, specific cooling capacity regain in the second evaporator 424 is provided. The embodiment 400 in FIG. 7 is provided primarily to illustrate one embodiment of the present invention in a refrigeration circuit including a plurality of compressors or a compressor having a plurality of stages.

It is contemplated that in some refrigeration systems, all of the energy efficiencies and reduced costs provided by the present invention may not be strictly necessary. As a result, others may attempt to modify the invention as described herein, such modifications resulting in varying efficiency and/or increased costs relative to the described embodiments. For example, a plurality of compressors or a compressor having a plurality of stages or any combination thereof, along with the refrigerant flow control means, may be utilized. Such modifications are possible, contemplated, and within the scope of the appended claims. Further, while the present invention is described herein sometimes with reference to a household refrigerator, it is not limited to practice with and/or in a household refrigerator.

While preferred embodiments have been illustrated and described herein, it will be obvious that numerous modifications, changes, variations, substitutions and equivalents, in whole or in part, will now occur to those skilled in the art without departing from the spirit and scope contemplated by the invention. Accordingly, it is intended that the invention herein be limited only by the scope of the appended claims.

What is claimed is:

1. A refrigeration circuit comprising:

compressor means;

a condenser connected to receive refrigerant discharged from said compressor means;

a first evaporator connected to receive at least a portion of the refrigerant discharged from said condenser;

a second evaporator connected to receive at least a portion of the refrigerant discharged from said first evaporator;

flow control means connected to receive at least a portion of the refrigerant discharged from said first evaporator and at least a portion of the refrigerant discharged from said second evaporator, said flow control means being repeatedly operable to alternately connect one of said first evaporator and said second evaporator at a time in exclusive refrigerant flow relationship with said compressor means;

a first conduit connecting the outlet of said second evaporator to said flow control means;

a second conduit connecting said condenser to the inlet of said first evaporator; and a third conduit coupled to the inlet of said second evaporator, said first conduit being at least partially disposed in a first heat transfer arrangement with at least a portion of said second conduit and being at least partially disposed in a second heat transfer arrangement with at least a portion of said third conduit.

2. A refrigeration circuit in accordance with claim 1 further comprising an accumulator disposed in said first conduit between said second evaporator and said first heat transfer arrangement.

3. A refrigeration circuit in accordance with claim 1 wherein said first and second heat transfer arrangements are both counterflow heat transfer arrangements.

4. A refrigeration circuit in accordance with claim 1 wherein said second conduit includes a first capillary tube, said first capillary tube forming at least part of said first heat transfer arrangement, and said third conduit includes a second capillary tube, said second capillary tube forming at least part of said second heat transfer arrangement.

5. A refrigeration circuit comprising:

a compressor;

a plurality of evaporators, one of said evaporators being arranged to operate at a temperature lower than the operating temperature of another of said evaporators;

a flow controller connected to receive at least a portion of the refrigerant discharged from each of said evaporators, said flow controller being repeatedly operable to alternately connect either of said evaporators at a time in exclusive refrigerant flow relationship with said compressor;

a first conduit connected to the inlet of said one evaporator; and a second conduit connected to the outlet of said one evaporator, said second conduit being at least partially disposed in a first heat transfer relationship with said first conduit.

6. A refrigeration circuit in accordance with claim 5 wherein said first heat transfer arrangement is a counterflow heat transfer arrangement.

7. A refrigeration circuit in accordance with claim 5 wherein said second conduit includes an accumulator disposed in the refrigerant flow path between said one evaporator and said first heat transfer arrangement.

8. A refrigeration circuit in accordance with claim 5 wherein said first conduit includes a capillary tube.

9. A refrigeration circuit in accordance with claim 5 further comprising a third conduit connected to the inlet of another one of said evaporators, said second conduit being at least partially disposed in a second heat transfer arrangement with said third conduit.

10. A refrigeration circuit in accordance with claim 9 wherein said second heat transfer arrangement is a counterflow heat transfer arrangement.

11. A refrigeration circuit in accordance with claim 9 wherein said third conduit includes a capillary tube.

* * * * *